United States Patent [19]

Plaisance

[11] Patent Number: 4,697,956

[45] Date of Patent: Oct. 6, 1987

[54] PIVOTAL BUMPER ATTACHMENT

[76] Inventor: Teddy J. Plaisance, R. R. 1, Box 243, Golden Meadow, La. 70357

[21] Appl. No.: 750,920

[22] Filed: Jul. 1, 1985

[51] Int. Cl.[4] ..... E02B 3/22; B63B 59/02

[52] U.S. Cl. ..... 405/213; 405/212; 114/220

[58] Field of Search ..... 405/211-215; 114/219, 220; 267/139, 140; 403/68, 157

[56] References Cited

U.S. PATENT DOCUMENTS

| | | | |
|---|---|---|---|
| 3,250,171 | 5/1966 | Taylor | 403/157 X |
| 3,564,858 | 2/1971 | Pogonowski . | |
| 3,798,916 | 3/1974 | Schwemmer | 114/219 X |
| 3,991,582 | 11/1976 | Waldrop et al. | 405/213 |
| 4,005,672 | 2/1977 | Files . | |
| 4,098,211 | 7/1978 | Files et al. . | |
| 4,109,474 | 8/1978 | Files et al. . | |
| 4,184,783 | 1/1980 | Hall | 403/157 |
| 4,273,473 | 6/1981 | Thomerson et al. . | |
| 4,293,241 | 10/1981 | Helveston et al. . | |
| 4,377,009 | 6/1982 | Jackson | 405/212 |
| 4,388,025 | 6/1983 | Evans . | |
| 4,426,174 | 1/1984 | Drewett et al. . | |
| 4,494,738 | 1/1985 | Britton et al. . | |
| 4,548,151 | 10/1985 | Files et al. | 114/219 |

FOREIGN PATENT DOCUMENTS

| | | | |
|---|---|---|---|
| 811585 | 4/1959 | United Kingdom | 403/157 |

*Primary Examiner*—Richard J. Scanlan, Jr.
*Assistant Examiner*—Nancy J. Stodola
*Attorney, Agent, or Firm*—Keaty & Keaty

[57] ABSTRACT

A bumper for attachment to a leg of an offshore platform comprising an upright, bumper holding element which carries resilient bumper members. A first arm projects outwardly from the upright element above the water line for fixed attachment to the leg of the platform above the water line. A second, submerged arm projects outwardly from the upright element and is pivotally connected below the water line to the leg. This structure allows the bumper to be quickly and efficiently replaced with a minimum amount of diver time required. The bumper is easily positioned in a vertical orientation regardless of the slope of the platform leg, and all welding is performed above the surface of the water.

13 Claims, 2 Drawing Figures

PIVOTAL BUMPER ATTACHMENT

BACKGROUND OF THE INVENTION

1. Field of the Invention

This invention relates to a bumper mounted on legs or other structural members of oil rig platforms for preventing damage by docked vessels or other floating objects.

2. General Discussion of the Background

Offshore drilling operations are often conducted from an elevated platform which is held in spaced relationship above the surface of the water by a plurality of legs supported by the ocean floor. Since it is necessary to bring food, supplies and personnel to the rig, boats often dock alongside the legs of the platform. These vessels and other free floating objects can seriously damage the legs of the platform, thereby endangering the structural integrity of the rig itself.

In order to avoid problems caused by damage to the legs, bumpers have been secured to the legs to provide a resilient structure in spaced, somewhat parallel relationship to the leg for preventing boats and other floating objects from damaging the leg. Examples of such bumpers are found in U.S. Pat. Nos. 4,005,672, 4,098,211, 4,109,474, 4,293,241, 4,273,473, 4,426,174 and 4,388,025. All of these patents disclose a vertically oriented bumper for a marine structure secured by a pair of parallel, horizontally disposed connection arms. These structures, however, suffer from several common defects.

In the first place, it is difficult and time consuming to orient the bumper vertically adjacent the leg of the platform. This difficulty is caused by the fact that the leg of the platform is always inclined at an angle to the vertical, and this angle is seldom the same on any two legs since the angle is determined by the specific floor conditions and other factors unique to this particular rig. It therefore becomes difficult to align a bumper vertically by connecting it with a pair of horizontal connection arms which are secured to the leg because the rigid horizontal connection arms must be of an appropriate length and relative angle to the bumper in order to achieve a vertical orientation of the bumper member.

Yet another problem with previously known structures is that the underwater horizontal connection arm must be welded to the leg of the platform underwater. Such subsurface welding requires several qualified divers who are experienced with welding. This means that initial installation or replacement of bumpers becomes a very time consuming and expensive procedure because of the requirement for underwater welding personnel.

Yet another problem with most prior art structures is that once the bumper is damaged, the entire bumper structure and horizontal connection arms must be removed and replaced. This results in greater cost of materials as well as an increase in personnel cost.

It is accordingly an object of this invention to provide a bumper attachment which can be easily vertically oriented in relation to the legs of offshore platforms which are frequently inclined at varying angles.

Another object of the invention is to provide a pivotal bumper attachment which reduces the necessity for employing subsurface welders.

Still another object of the invention is to provide a bumper attachment which requires only partial replacement after it is damaged.

Yet another object of the invention is to provide a bumper attachment which greatly reduces the amount of time required for replacement and repair of bumpers on oil rigs.

Still another object of the invention is to provide a bumper attachment that will not sink if it is damaged by impact from a vessel or other floating object.

SUMMARY OF THE INVENTION

The aforementioned objects are achieved by providing a bumper for attachment to the leg of an offshore platform, the bumper comprising an upright member which carries resilient bumper members therearound. A first arm projects outwardly from the upright element for attachment to a leg of the platform above the water line. A second arm projects outwardly from the upright element below the water line and is pivotally interconnected to the leg below the water line.

In preferred embodiments, a brace is fixed to the leg below the water line, the brace carrying a projection comprised of a pair of plates which have a pair of opposing, parallel coa-axially aligned holes that define a horizontal pivot axis beneath the surface of the water. A corresponding projection is carried by the upright element, the corresponding projection also having an opening which fits coaxially with the holes in the projection from the brace. A pivot pin is then placed through the coaxially aligned holes to provide a pivotal attachment between the upright element and the leg.

The resulting structure provides a means by which a damaged bumper can be quickly and relatively inexpensively replaced. The necessity for underwater welding is eliminated by virtue of the pivotal connection between the upright element and the leg. The stationary brace fixed to the leg below the water will also not be damaged since the pivotal connection absorbs damaging forces before they can affect the brace. The only portions of the bumper which accordingly need to be replaced would be the upright element, the projection, and the top horizontal arm connecting the upright element to the leg above the water. The only connection which will require welding is the connection between the top horizontal arm and the leg above the surface of the water. The pivotal attachment below the surface of the water also greatly enhances the ability to easily vertically align the bumper adjacent the leg.

BRIEF DESCRIPTION OF THE DRAWINGS

A better understanding of the invention can be had by reference to the following drawings in which like reference numerals refer to like parts and in which.

DETAILED DESCRIPTION OF THE PREFERRED EMBODIMENT

Figure 1:
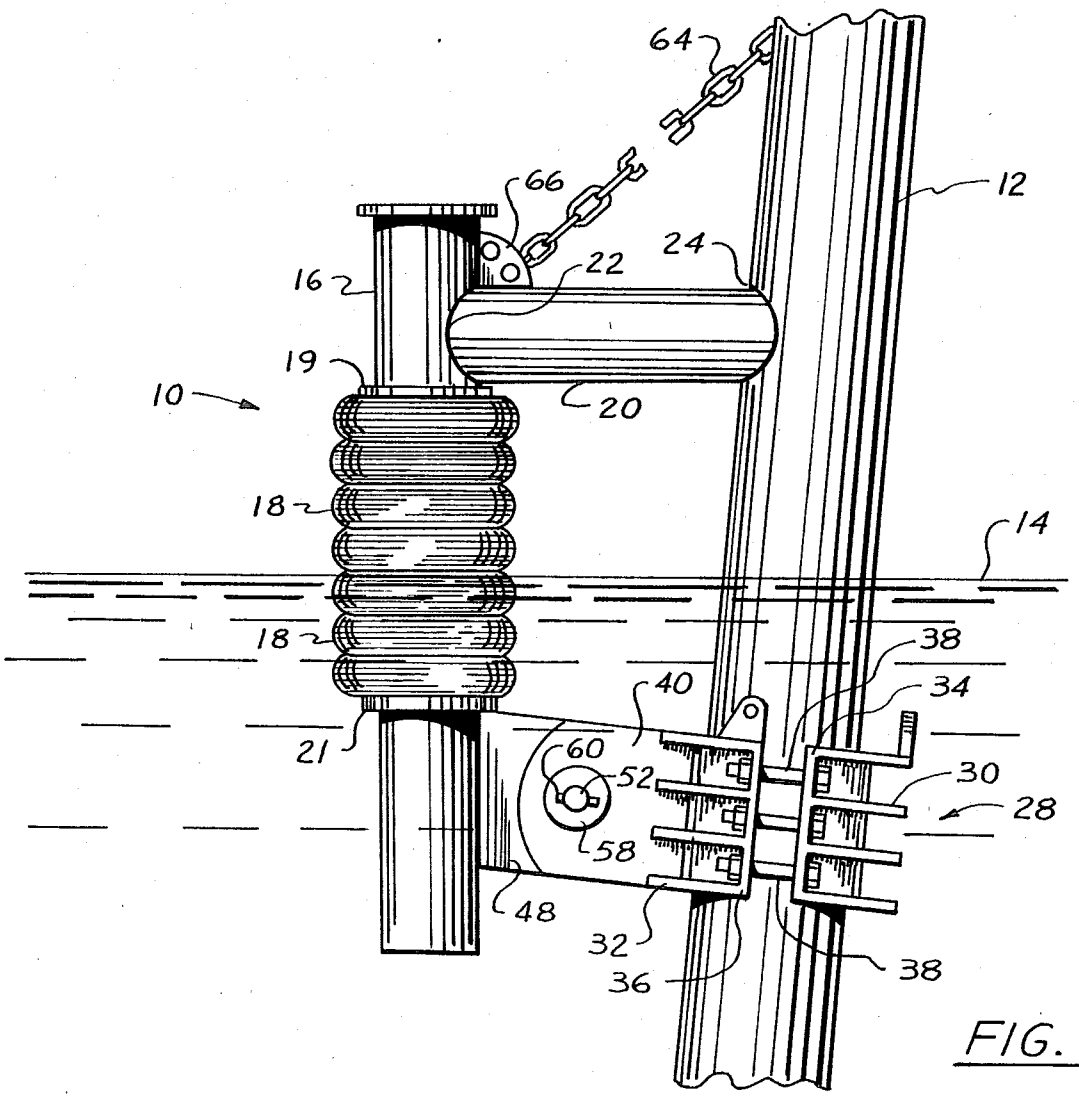
FIG. 1 is a fragmentary, side view of a pivotal bumper attachment made in accordance with the present invention, the top and bottom portions of a leg of an offshore platform being cut away.
Figure 2:
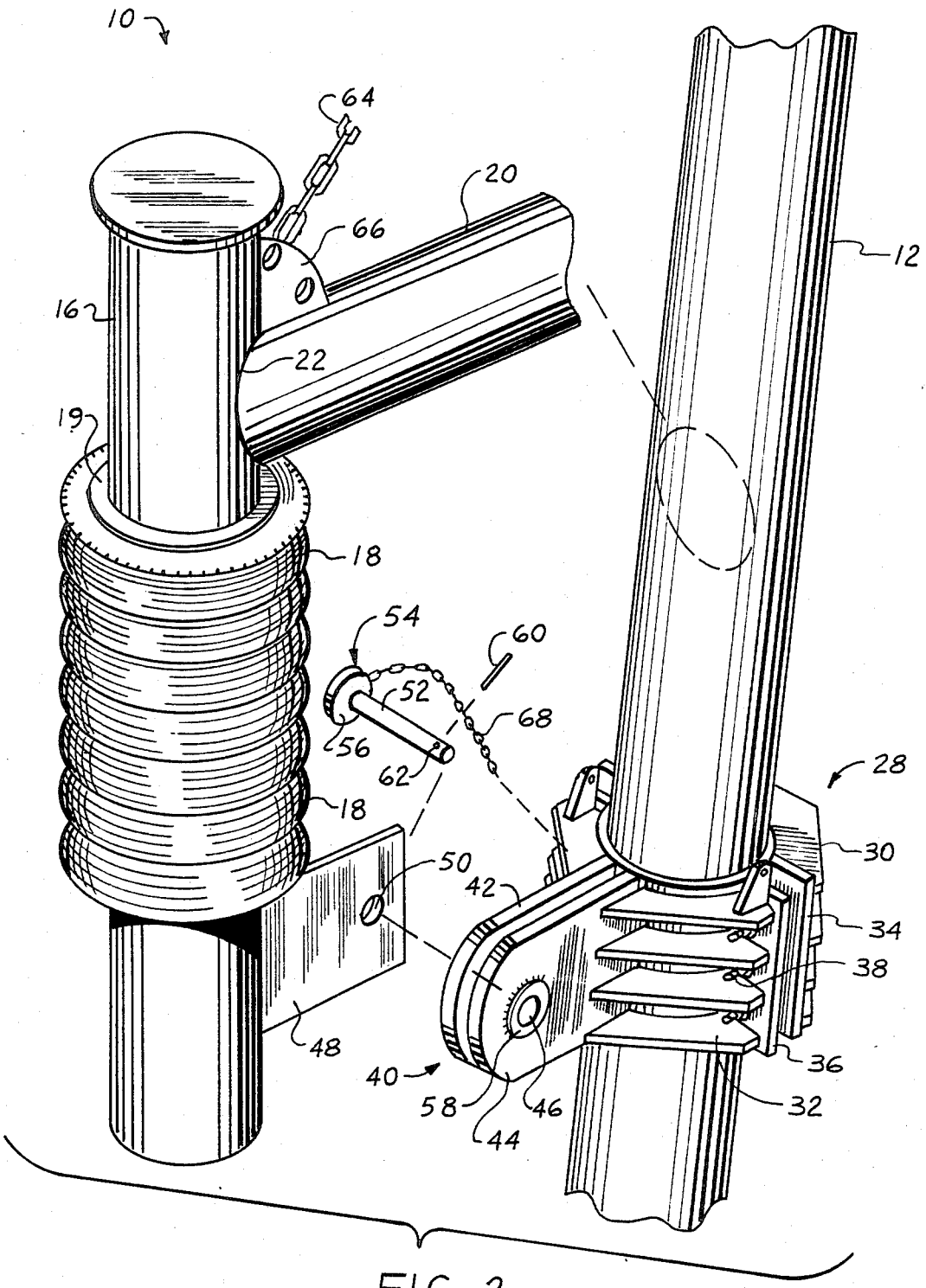
FIG. 2 is an enlarged, perspective view of a pivotal bumper attachment showing in greater detail the pivot pin which provides the pivotal connection.

A bumper 10 for attachment to a leg 12 of an offshore platform (not shown) is seen in FIGS. 1 and 2 to be comprised of a leg having a submerged portion below a water line 14. A cylindrical upright element 16 carries a plurality of resilient bumper members 18 which are in the nature of tires, rubber rings, or other resilient members known in the art for providing resilient protection for leg 12. In the preferred embodiment shown in the drawings, seven rubber tires are shown disposed around element 16, although it is evident that any number of members 18 can be used to achieve the same protective effect as long as they intersect the water line 14 and extend sufficiently above and below water line 14 to provide protection against floating vessels and other objects. Members 18 are carried between upper and lower retainer flanges 19, 21 extending annularly outwardly from element 16 and below waterline 14.

A first arm 20 projects outwardly from upright element 16 and is fixed in immovable, fixed relationship to the leg 12 above waterline 14, for example be welding at joints 22, 24. A second arm 48 projects outwardly from upright element 16 below water line 14. Second arm 48 is connected to a brace 28, which is further comprised of a pair of opposing, complementary clamping members 30, 32. Each member 30, 32 has an arcuate inner face (not shown) which fits in contiguous relationship with a portion of leg 12, members 30, 32 further comprising a pair of opposing, upright flanges 34, 36 which have a plurality of opposing, parallel openings (not shown). In the embodiment shown in FIGS. 1 and 2, three such pairs of openings are provided on each side of each member 30, 32, and members 30, 32 are held in clamping engagement with leg 12 by placement of a plurality of nut and bolt assemblies 38 therethrough.

Brace 28 is further comprised of a projection 40 having a pair of parallel plates 42, 44, (FIG. 2) each of which has a hole 46 therein. The holes 46 in each of plates 42 are formed in spaced, opposing, parallel and co-axial relationship to define a horizontal pivot axis below water line 14. Second arm 48 is also comprised of a flat plate projecting outwardly from element 16 below water line 14 and having a width no greater than the distance between plates 42, 44 so that second arm 48 is easily received in sliding relationship therebetween. In the embodiment shown in FIG. 1, second arm 48 is placed in sliding relationship between plates 42, 44 so that an opening 50 in second arm 48 (see FIG. 2) is coaxially aligned with the holes 46 of projection 40.

A pivot pin 52 is disposed through holes 46, 50 to provide a pivot about which second arm 48 can rotate. Pivot pin 52 is provided with an enlarged head 54 having a diameter greater than the diameter of holes 46, the inner face 56 of head 54 riding against seats 58 of projection 40. Pivot pin 52 is retained in fixed engagement with holes 46, 50 by means of a retaining pin 60 which is inserted through a cylindrical channel 62 through pin 52. The channel 62 and retaining pin 60 are disposed substantially perpendicularly to the longitudinal axis of pin 52, and pin 60 has a length greater than the diameter of pin 52 or the diameter of holes 46.

A chain 64 is connected between tab 66 and leg 12 for holding bumper 10 in fixed attachment to the leg in the event that bumper 10 is damaged and dislodged. Pin 52 is similarly connected to brace 28 by means of a chain 68 which prevents the pin from being dropped when a diver is manipulating it for insertion through holes 46, 50.

In operation, a brace 28 is fixed around leg 12 below water line 12 by bringing flanges 34, 38 into opposing, parallel relationship and inserting nut and bolt assemblies 38 through the holes in flanges 34, 36. After brace 28 has been secured to leg 12, a diver is sent below the surface of waterline 14 to place a second arm 48 between plates 42, 44 and co-axially align holes 46, 50. Pin 52 is then placed through holes 46, 50 and secured in place by placing retaining pin 60 through passageway 62 and locking it in place. Joint 24 is then is formed between first arm 20 and leg 12 by welding arm 20 to leg 12. In the event bumper 10 is damaged by a vessel or other floating object, bumper 10 will be dislodged by the collision from leg 12 either at joint 24 or at pivot pin 52. This will necessitate replacement of only upright element 16, first arm 20 and second arm 48 since brace 28 will already be fixed about leg 12. The pivotal attachment between second arm 48 and brace 28 eliminates the problem encountered in the prior art of using subsea welders to repair the bumper. The upright element can also be attached to leg 12 in a substantially vertical orientation regardless of the angle of inclination of leg 12, the length of the top or bottom arms, or the angles at which the top or bottom arms project away from element 16.

The foregoing preferred embodiment of the invention has been disclosed in accordance with requirements of law. This description is not intended to limit the scope of the invention, which is more appropriately construed in accordance with the following claims.

I claim:

1. A bumper for attachment to a leg of an off shore platform, comprising:

an upright element which carries resilient bumper means;

a first arm projecting outwardly from the upright element for attachment to a leg of the platform above a water line; and a second arm projecting outwardly from the upright element and means for pivotally connecting the second arm to the leg below the water line to facilitate vertical alignment of the upright element, said means for pivotally connecting the second arm to the leg below the water line comprising:

a brace fixed to the leg, the brace comprising:

a projection which defines a pivot axis below the water line; and a pivotal joint between the second arm and the projection at the pivot axis.

2. The bumper of claim 1, wherein the projection comprises a pair of parallel plates, each of which has a hole therein, the holes having a common axis and forming the pivot axis.

3. The bumper of claim 2, wherein the second arm is a flat plate that fits between the parallel plates of the projection, the second arm having an opening which is co-aligned with the holes in the projection, and a pviot pin is disposed in fixed engagement through the holes and opening.

4. The bumper of claim 3 wherein the first arm is fixed in welded engagement to the leg above the water line.

5. The bumper of claim 4 wherein the brace further comprises opposing, complementary clamping members which fit in clamping engagement around the leg below the water line, the opposing members being held in clamping engagement with the leg by a plurality of bolts.

6. The bumper of claim 5, wherein the resilient bumper means is comprise a plurality of resilient rings circumscribing the upright element.

7. A bumper for attachment to a leg of an offshore platform, the leg having a submerged portion below a water line, said bumper comprising:

a cylindrical upright element which carries a plurality of resilient bumper members, the bumper members comprising a plurality of resilient rings circumscribing the upright element and intersecting the water line;

a first arm projecting outwardly from the upright element and fixed in immovable fixed relationship to the leg above the water line;

a second arm projecting outwardly from the upright element below the water line;

a brace in fixed relationship to the submerged portion of the leg, the brace comprising a projection which comprises a pair of parallel plates, each of which has a hole therein, the holes having a common axis, the second arm comprising a flat plate that fits between the parallel plates of the projection, the flat plate having an opening which is coaxially aligned with the holes of the projection, and a pivot pin disposed in fixed engagement through the holes and opening to provide a pivotal connection between the second arm and the leg to facilitate vertical alignment of the upright element.

8. The bumper of claim 7, wherein the first arm is fixed in welded engagement to the leg above the water line.

9. The bumper of claim 8, wherein the brace further comprises a pair of opposing, complementary clamping members which fit in clamping engagement around the leg below the water line, the opposing members being held in clamping engagement with the leg by a plurality of bolts.

10. A method of attaching a bumper to a leg of an offshore platform, the leg having a submerged portion below a water line, the method comprising the steps of:

providing a bumper having an upright element which carries resilient bumper members, a first arm projecting outwardly from the upright element, and a second arm projecting outwardly from the upright element in the same direction as the first arm;

pivotally interconnecting the second arm to the submerged portion of the leg in order to facilitate vertical alignment of the upright element; and then attaching the first arm to the leg above the water line.

11. The method of claim 10, wherein the first arm is welded to the leg.

12. The method of claim 11, wherein the second arm is pivotally interconnected to the submerged portion of the leg by first attaching a pivot structure to the submerged portion of the leg, then pivotally interconnecting the second arm and pivot structure.

13. The method of claim 12, wherein the pivot structure is a brace in fixed engagement with the submerged portion of the leg.

* * * * *